United States Patent [19]

Nelson

[11] Patent Number: 4,828,026

[45] Date of Patent: May 9, 1989

[54] REMOTELY OPERABLE DOWNHOLE JUNK BASKET SYSTEM

[75] Inventor: S. Parr Nelson, Conroe, Tex.

[73] Assignee: Wilson Industries, Inc., Houston, Tex.

[21] Appl. No.: 191,681

[22] Filed: May 9, 1988

[51] Int. Cl.[4] ..... E21B 31/06

[52] U.S. Cl. ..... 166/99; 294/86.11

[58] Field of Search ..... 166/66.5, 99, 301; 294/86.11

[56] References Cited

U.S. PATENT DOCUMENTS 3,203,491 8/1965 Turley ..... 166/66.5 X 4,059,155 11/1977 Greer ..... 166/99 X

*Primary Examiner*—William P. Neuder

*Attorney, Agent, or Firm*—Arnold, White & Durkee

[57] ABSTRACT

A remotely operable downhole basket for use at the bottom of a fishing string in a well bore has a tubular body. Inside the tubular body is a tubular finger basket having a plurality of slots in which fingers are pivotally mounted. The fingers are normally biased out of the slots into horizontal positions. At the bottom of the tubular body is a tubular opener. The outer side of the tubular opener is in a vertically sliding relationship with the inside wall of the tubular body. The opener is configured at its upper end to push the fingers into their respective slots. The tubular opener has an actuator shoe at the lower end of the tubular opener. The top end of the actuator shoe is adapted to abut against the lower end of the tubular body to stop upward travel of the opener relative to the tubular body. A circular return spring is positioned between the outer side of the tubular opener and the inside wall of the tubular body. The return spring exerts a force on the tubular opener which is downward relative to the tubular body.

10 Claims, 2 Drawing Sheets

Fig. 5B
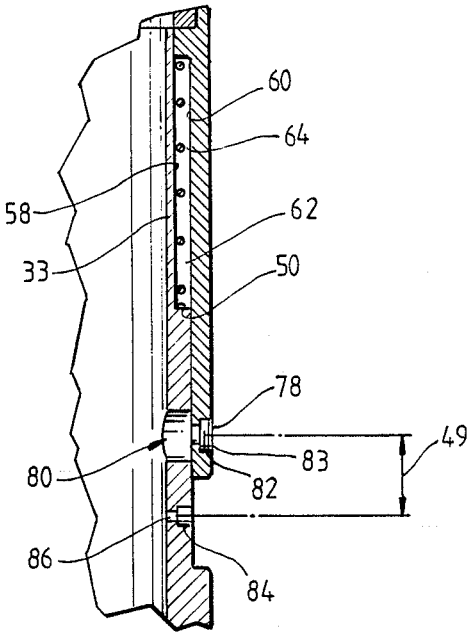
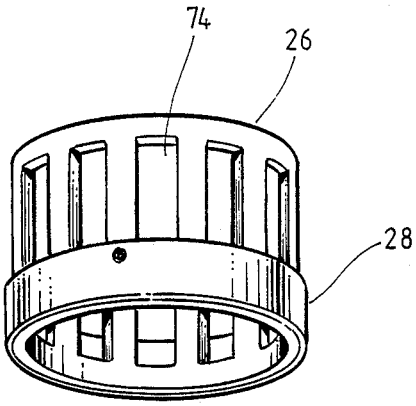
Fig. 2
Fig. 5A
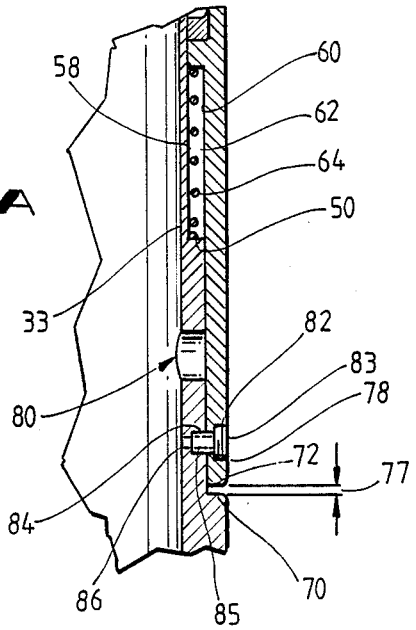

REMOTELY OPERABLE DOWNHOLE JUNK BASKET SYSTEM

BACKGROUND AND SUMMARY OF THE INVENTION

This invention relates to tools for retrieving items from the bottom of a well bore, and, more particularly, to tools for bringing the retrieved item back to the surface from the bottom of the well bore.

Typical prior art tools for bringing to the surface items retrieved from the bottom of a well bore are disclosed in the following U.S. Pat. Nos. 2,493,992; 2,520,783; and 3,203,491. These prior art tools, however, have various limitations. For example, the tools disclosed in U.S. Pat. No. 2,493,992 can be actuated only once before withdrawing the entire fishing string. The embodiment shown in FIGS. 1 and 2 includes a junk basket arrangement that is closed by mechanical actuation of the tool, while the basket shown in FIG. 3 is actuated by use of an electromagnet. In each case, however, once the basket is closed, it is apparent that the basket cannot be re-opened without withdrawing the entire fishing string out of the well bore. Thus, it is not possible to lower an electromagnet through the basket, once the basket has been closed. The baskets disclosed in U.S. Pat. Nos. 2,520,783 and 3,203,491 have similar limitations. The basket disclosed in U.S. Pat. No. 2,520,783 is actuated mechanically, while the basket in U.S. Pat No. 3,203,491 is actuated hydraulically. In either case, an electromagnet can not be lowered through the basket once the basket has been closed.

The present invention overcomes the above-noted and other drawbacks of the prior art by providing a remotely operable downhole junk basket system which allows an operator to open and close the basket as often as is desired while it is at the bottom of a well. Expressed otherwise, the basket can be opened more than once down the hole so that an electromagnet can be raised and lowered repeatedly through the basket.

The invention in a general sense comprises an inner tubular member which fits within an outer tubular member in an axially or longitudinally slideable relation. The outer member is adapted to attach to the lower end of a pipe string; it serves as a tubular driver in transmitting axial or torque loadings from the pipe string. The inner tubular member serves as a tubular opener; it provides an opening through which a fish in a well may be retrieved. The lower end of the inner tubular member preferably comprises a bit, a washover shoe, or other tool for engaging the bottom of a well.

A lower internal wall portion of the outer tubular member or tubular driver and an upper external wall portion of the inner tubular member or tubular opener are configured to define one or more annular chambers or cavities to house springs which are compressed upon upward axial movement of the inner tubular member relative to the outer tubular member. The spring or springs thereby urge the inner tubular member downward relative to the outer tubular member when the two members telescope together.

A junk catcher or basket is mounted in the internal wall of the outer tubular member above the spring chamber or cavity. The catcher or basket comprises a cylindrical housing with a plurality of arcuately spaced internal openings to house a corresponding plurality of fingers. Each finger is spring-loaded and pivotally mounted at its lower end in its respective opening to extend radially inward in a lateral, or transverse, position. In their transverse position, the fingers overhang the upper end of the inner tubular member, such that upward movement of the inner tubular member relative to the outer tubular member forces the fingers into their retracted vertical positions within the basket. Preferably, the inner tubular member is provided with sufficient axial travel such that its upper end can slide within the basket with the fingers in their retracted position.

Releasable interlocking means may be employed to hold the inner and outer tubular members telescoped together with the basket fingers in their retracted vertical position. A preferred such means is a shear pin which may be sheared by bumping the inner tubular member against the bottom of the well.

When the two tubular members are telescoped together, a junk retriever such as a hook or an electromagnet may be lowered on a wire line, reelable tubing or the like down through the basket to a piece of junk, a fish, or other object at the bottom of a well. The retrieved object may then be lifted above the retracted fingers. The fingers may then be released to a lateral position to form the bottom of a basket, to hold the retrieved object. If desired, as for example when employing an electromagnet, the basket itself may be used to carry the object to the surface of the earth.

BRIEF DESCRIPTION OF THE DRAWINGS

The above-noted and other aspects of the present invention will become more apparent from a description of the following preferred embodiment when read in conjunction with the accompanying drawings.

The drawings illustrate a preferred embodiment of the invention, wherein like members bear like reference numerals and wherein:

FIG. 2 is a perspective view of a junk catcher used in a remotely operable downhole junk basket system built according to the present invention;

FIG. 5A is an enlarged cross sectional side view of part of FIG. 4, illustrating a shear pin arrangement used to keep the junk basket open; and FIG. 5B is the view of FIG. 5A illustrating removal of the shear pin fragment after the shear pin has been sheared.

DESCRIPTION OF A PREFERRED EMBODIMENT

Figure 1:
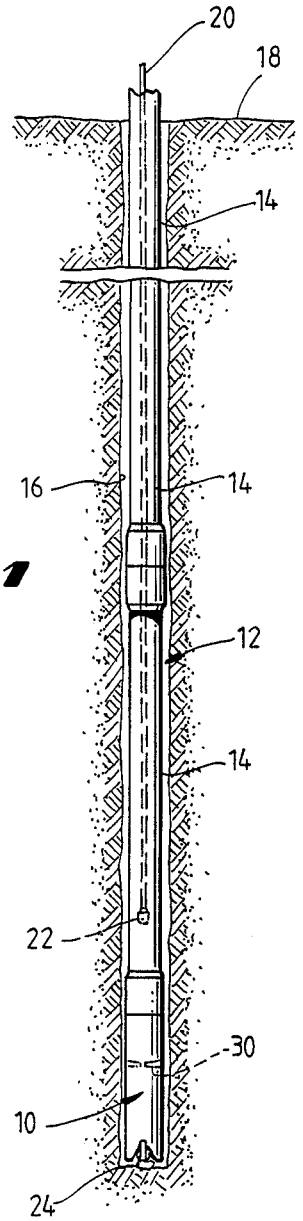
FIG. 1 is an illustration of the environment in which a remotely operable downhole junk basket system built according to the present invention may be used.

Referring to FIG. 1, there is illustrated the environment in which a remotely operable downhole junk basket built according to the present invention may be used. A junk basket system 10 is connected to the lower end of a fishing string 12. More particularly, an adapter 13 connects the junk basket system 10 to the lower end of the fishing string 12. The fishing string 12 is typically composed of a plurality of sections 14 of drill pipe. As additional sections 14 are added to the fishing string 12, the fishing string 12 is lowered further into the well bore 16. This process of adding additional sections 14 of drill pipe continues until the junk basket system 10 reaches the bottom of the well bore 16. From above the ground 18 an electric cable 20 is inserted into the fishing string 12. Attached to the end of the electric cable 20 is a retrieval device, preferably an electromagnet 22. The electromagnet 22 is lowered through the remotely operated junk basket system 10 until the magnet 22 contacts a piece of junk 24, such as a broken drill head, at the bottom of the well bore 16. Then the electromagnet 22 is energized by means of the electric cable 20, thus causing the piece of junk 24 to attach itself to the electromagnet 22. The piece of junk 24 is then raised above the junk basket system 10, the junk basket system 10 is closed, and then the electromagnet 22 is deenergized, causing the piece of junk 24 to fall into and be caught by the junk basket system 10.

Figure 3:
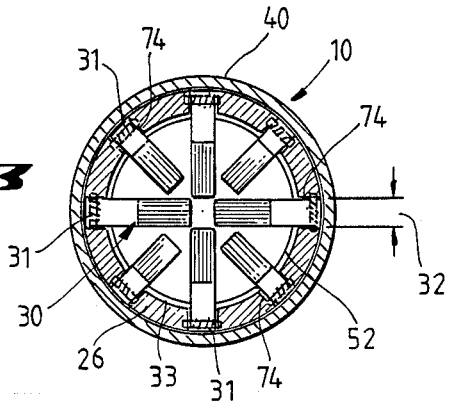
FIG. 3 is a top view of the junk catcher of FIG. 2; it is also a view taken along the section lines 3—3 of FIG. 4.

Referring to FIG. 2, the junk basket system 10 includes a finger basket 26, illustrated in a perspective view, having a tubular body 28. Referring to FIG. 3, the finger basket 26, illustrated in a top view, has fingers 30 which open and close. In FIG. 3 the fingers 30 are depicted in a closed, or extended position. Each finger 30 has a corresponding spring 31 which forces the finger 30 into the closed, or extended, position. The fingers may all be the same length, or may be various lengths, depending on the diameter of the tubular body 28 and depending on the size and weight of the piece of junk 24 expected to be retrieved. However, in a preferred embodiment alternate fingers are longer than the rest of the fingers. Although FIG. 3 illustrates eight fingers 30, there may be any number of fingers 30. In a preferred embodiment, in which the junk basket system 10 has an outside diameter of nine inches, there are twelve fingers 30. The fingers 30 may be made of any suitable material, but in a preferred embodiment they are made of cast bronze. The width 32 may be any suitable width depending on the number of fingers 30 and the inside diameter of the junk basket system 10.

Figure 4:
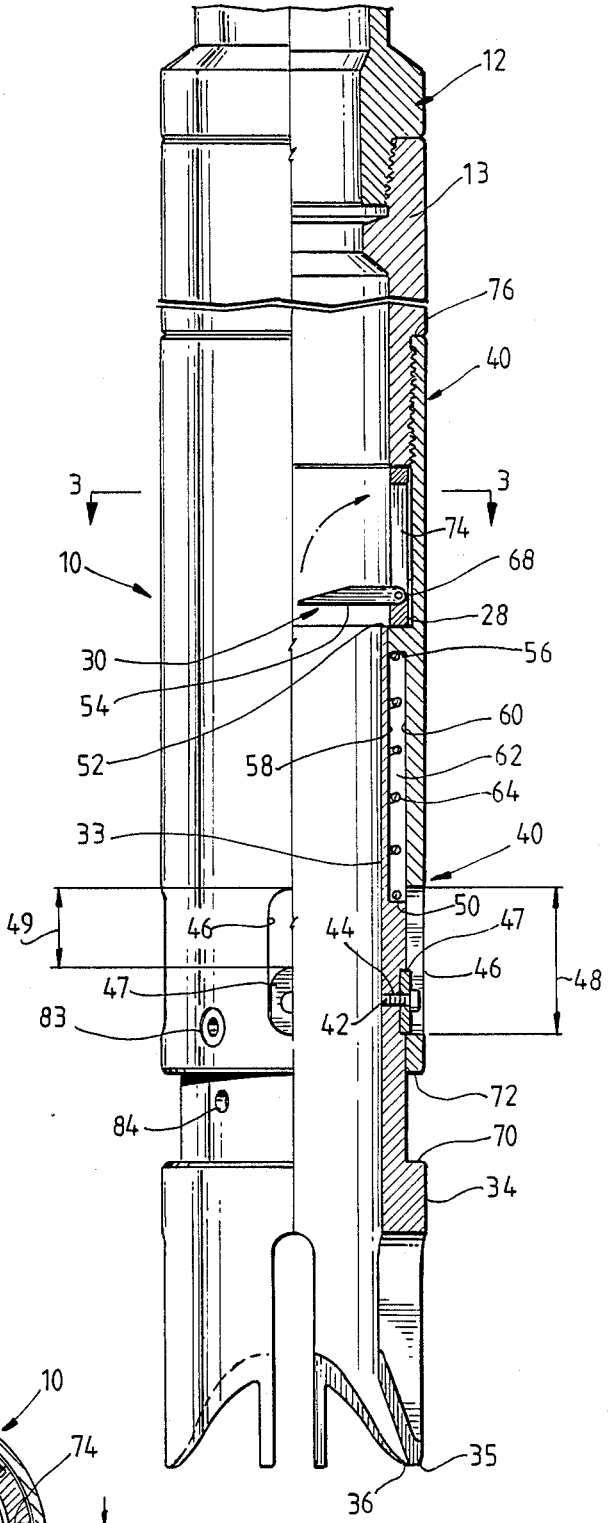
FIG. 4 is a partial cross-sectional side view of a fishing string containing a remotely operable downhole junk basket system built according to the present invention.

Referring to FIG. 4, the junk basket system further includes a tubular opener 33. The tubular opener 33 at its lower end has an actuator shoe 34. The actuator shoe 34 has a bottom end 35. The bottom end 35 has an edge 36 for contacting, scouring or dragging against the bottom of the drill hole 16. The bottom end 35 is preferably one piece with the actuator shoe 34. The tubular opener 33 is in a sliding relationship with a tubular driver 40, which is threaded to the bottom of the fishing string 12.

Four driver bolts 42 are inset within the driver 40 and are threaded into screw holes 44 in the tubular opener 33. Near the lower end of the driver 40—e.g., about one inch from the bottom of the inside wall of the driver 40—are four drive key slots 46, through which a driver bolt 42 passes, bolted to a drive key 47 which slides in the drive key slot 46. The four drive key slots 46 are spaced approximately ninety degrees from each other. Each drive key slot 46 is just wide enough to allow the drive key 47 to slide in it. The close sliding relationship between the drive key slots 46 and the drive keys 47 allow torque applied to the tubular driver 40 to be efficiently transmitted to the actuator shoe 34. Thus, rotational movement of the tubular driver 40 causes the bottom end edge 36 to rotate, which rotation may be used to scrape the bottom of the well bore 16.

Each drive key slot 46 is a slot which has a length 48, which length 48 is substantially one-half the length of the longer fingers 30. The length 48 of the drive key slot 46, minus the length of the drive key 47, is the length of the travel 49 which the actuator shoe 34 can travel in sliding relationship with the driver 40. Thus, the key slots 46 must be long enough to enable the fingers to be actuated between an extended, closed position and a retracted, open position in response to movement of the tubular opener 33 relative to the driver 40.

In a preferred embodiment, a short distance above the drive key slots 46—for example, approximately one and one-half inches above the top of the drive key slots 46—the tubular opener 33 is cut inwardly about two-thirds of its thickness for the rest of its length, thus forming a ledge which acts as a spring catch 50. Above the spring catch 50 the inner one-third of the thickness of the tubular driver 40 extends upward—typically about four and one-half inches—such that when the tubular opener 33 is slid as far down as the driver bolt 42 sliding in the drive key slot 46 will allow the tubular opener 33 to slide, a top end of the tubular opener 33, acting as a finger catcher 52, is below a bottom edge 54 of each finger 30, when the fingers are in their extended, horizontal position, as shown in FIG. 3.

The driver 40 has an annular protrusion 56 which extends inwardly a distance of substantially two-thirds the thickness of the tubular opener 33 so that the finger catcher 52 is in a sliding relationship with the inner edge of the annular protrusion 56. An outside wall 58 of the tubular opener 33, an inside wall 60 of the driver 40, together with the spring catch 50 and a bottom edge of the annular protrusion 56, form a cavity 62 in which a circular return spring 64 exerts a force downward on the spring catch 50.

Resting on top of the annular protrusion 56 is the finger basket 26. The outer surface of the tubular finger basket 26 is in a loose, sliding engagement with the inner surface of the tubular driver 40, to allow the finger basket 26 to rotate freely within the tubular driver 40. In alternate embodiments, thrust bearings are inserted in the tubular driver 40 above and below the finger basket 26 to aid in the rotation of the finger basket 26 within the tubular driver 40. The finger basket 26 includes pivots 68 around which each finger 30 pivots. When force is exerted against the bottom end 35, the tubular opener 33 rises until a top end 70 of the actuator shoe 34 abuts against a driver bottom end 72 of the driver 40. Before the actuator top end 70 abuts against the driver bottom end 72, the finger catcher 52 abuts against the bottom edge 54 of each finger 30, pushing each finger 30, against the force of the spring 31, into a slot 74 in the finger basket 26. Thus, when the fingers are pushed into the slots 74, the edges 54 are in the same plane as the inside wall of the fishing string 12.

Referring now to FIG. 5A and FIG. 5B, the tubular driver 40 has an aperture 78 adapted to receive a shear pin. The tubular opener 33 has an aperture 80 with a diameter substantially three times as large as the diameter of the aperture 78. The aperture 78 has threads 82 adapted to receive a set screw 83. The apertures 78 and 80 are located below the drive key slots 46. The apertures 78 and 80 are aligned when the bottom of the tubular opener 33 does not press against anything. When the driver 40 is pressed down in relation to the tubular opener 33, an aperture 84, located in the tubular opener 33 below the aperture 80, becomes aligned with the aperture 78. When apertures 78 and 84 are aligned, the fingers 30 are in their respective slots 74.

As shown in FIG. 5A, a shear pin may be inserted into the aligned apertures 78 and 84, thus keeping the fingers 30 pushed by the finger catcher 52 into their respective slots 74. Thus, when the apertures 78 and 84 are held in alignment by a shear pin 85, keeper means are provided for keeping the fingers 30 in their respective slots 74 before the bottom end 35 of the actuator shoe 34 presses against the bottom of the well bore.

With a shear pin inserted in the aligned apertures 78 and 84, a gap 77 exists between the bottom end 72 of the tubular driver 40 and the top end 70 of the actuator shoe 34. The gap 77 is larger than the diameter of the shear pin to ensure that there is enough room for movement of the shoe 34 upwards to shear the shear pin 85. In the preferred embodiment, the shear pin diameter is three-sixteenths inch and the gap 77 is one-quarter inch. The aperture 84 has a pinhole 86 through which a pin may be inserted to push out the part of the shear pin remaining after the pin has been sheared.

In operation, when a piece of junk or "fish" 24 is at the bottom of the well bore 16, the junk basket system 10 is attached to the bottom end of the fishing string 12, and then the fishing string 12 is lowered into the well bore 16 until the bottom end 35 of the tubular opener 33 rests against the fish 24 or the bottom of the well bore 16. Preferably, the tubular opener 33 is telescoped within the tubular driver 40, and is held in position by a shear pin extending through apertures 78 and 84. Then the weight of the fishing string 12, with the adaptor 13 attached to the bottom, is allowed to push downward on the upper edge 76 of the tubular driver 40, shearing the shear pin and enabling the actuator top end 70 to abut against the driver bottom end 72. As the fishing string 12 presses the driver 40 downward, the finger catcher 52 presses the fingers 30 into the slots 74.

The operator can then lower the electromagnet 22 to the bottom of the well bore 16, collect the piece of junk 24, and then lift the piece of junk 24 above the tops of the fingers 30. At that point in time, the operator need merely lift the fishing string, together with the electric cable 20 and the electromagnet 22, a few more inches, and the return spring 64 then forces the finger catcher 52 down away from the fingers 30, allowing the springs 31 to force the fingers 30 to extend in their transverse, or horizontal, positions. The operator may then deenergize the electromagnet 22, thus dropping the piece of junk 24 on top of the extended fingers 30.

When using a shear pin in the apertures 78 and 84 to keep the junk catcher fingers open before the actuator shoe presses against the bottom of the well bore, the operator first inserts a shear pin in the aligned apertures 78 and 84, and then screws in a set screw in the threads 82 to keep the shear pin in the aligned apertures 78 and 84. As indicated earlier, the operator may then shear the pin by allowing the actuator shoe 34 to bump against the bottom of the well. When the actuator shoe bumps against the bottom of the well, the tubular opener 33 moves upwardly in relation to the tubular driver 40. This movement shears the shear pin 85.

After the operator has sheared the pin and has raised the junk basket system 10 to the surface, the operator has two shear pin fragments to remove. For the fragment in the aperture 84, the operator inserts a pin through the pinhole 86 and pushes the fragment of the shear pin out of the aperture 84.

For the fragment in the aperture 78, the operator pushes the fragment out of the aperture 78, and through and out of the aperture 80, the center of which is aligned with the aperture 78. As the aperture 80 has a diameter larger than the diameter of the aperture 78, the shear pin fragment is easily pushed through the aperture 80. Although the circular return spring 64 can be compressed to align the apertures 78 and 84, it can not be easily done by one person. The aperture 80 provides the way to remove the shear pin fragment from the aperture 78 without compressing the circular return spring 64.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A remotely operable downhole basket for use at the bottom of a fishing string in a well bore comprising:

a. a tubular driver having an inner driver wall and a lower end;

b. a tubular catcher having a inside catcher wall and an outside catcher wall fitted in the inner driver wall, the tubular catcher having:

(i) a plurality of circumferentially spaced vertical slots in the inside catcher wall;

(ii) a separate finger pivotally mounted within each slot, the fingers being normally biased out of the slots into horizontal positions within the catcher;

c. a hollow opener having an upper end, a lower end, an inner wall, and an outer wall, the outer wall being in a vertically sliding relationship with the inner driver wall, the lower end of the hollow opener extending past the lower end of the tubular driver, the hollow opener having:

i. a finger catcher at the upper end, the finger catcher adapted to push the fingers into their respective slots;

ii. an actuator shoe at the lower end, a top end of the actuator shoe adapted to abut against the lower end of the tubular driver to stop upward travel of the hollow opener relative to the tubular driver; and iii. a spring catch positioned on the outer wall of the hollow opener between the upper and lower ends thereof; and e. a circular return spring resting on top of the spring catch, and positioned between the outer side of the hollow opener and the inside driver wall to exert a force on the tubular opener which is downward relative to the tubular driver, whereby as the fishing string is lowered so that the bottom end of the actuator shoe is pressed against the bottom of the well bore the fingers are pushed upwardly into their respective slots, thus opening the basket, and as the fishing string is lifted up, the fingers return to horizontal positions, thus closing the basket.

2. The remotely operable downhole basket of claim 1 wherein the hollow opener is tubular.

3. The remotely operable downhole basket of claim 2 wherein the actuator shoe has a bottom end adapted to scrape the bottom of the well.

4. The remotely operable downhole basket of claim 3 wherein the combination of the tubular driver and the hollow opener includes means for keeping the fingers pushed by the finger catcher into their respective slots before the bottom end of the actuator shoe presses against the bottom of the well bore.

5. The remotely operable downhole basket of claim 4 wherein the top end of the actuator shoe abuts against the lower end of the tubular driver when or after the opener travels upwardly a distance sufficient to enable the finger catcher to push the fingers into their respective slots.

6. A remotely operable downhole basket for use at the bottom of a fishing string in a well bore comprising:

a. a tubular driver having a driver wall and a bottom end;

b. a tubular finger basket having a basket sidewall, an outside side of the sidewall in tight engagement with the inside of the driver wall, the tubular finger basket having:

(i) a plurality of circumferentially spaced vertical slots in the basket sidewall;

(ii) a finger pivotally mounted within each slot, the fingers being normally biased out of the slots into horizontal positions to form a bottom for the basket;

c. a tubular hollow opener having an upper end, a lower end, and an opener sidewall having an inner side and an outer side, the outer side in sliding engagement with the inner side of the driver wall, the lower end of the tubular hollow opener extending past the bottom end of the tubular driver, the tubular hollow opener having:

i. a configuration at the upper end capable of pushing the fingers into their respective slots;

ii. an actuator shoe at the lower end adapted to abut against the lower end of the tubular driver to stop upward travel of the tubular hollow opener relative to the tubular driver; and iii. a spring catch positioned on the outer side of the tubular hollow opener between the upper and lower ends thereof; and e. a circular return spring resting on top of the spring catch and positioned between the outer side of the tubular hollow opener and the inside side of the driver wall to exert a force on the tubular hollow opener which is downward relative to the tubular driver, and wherein the combination of the tubular driver and the tubular hollow opener includes keeper means for keeping the fingers pushed by the upper end of the tubular opener into their respective slots before the bottom end of the actuator shoe presses against the bottom of the well bore.

7. The basket of claim 6 wherein the keeper means comprises:

a. a first aperture extending through the driver wall, the aperture having a first diameter sufficient to receive a shear pin and also having threads to receive a set screw; and b. a second aperture alignable with the first aperture and extending through the opener wall, the second aperture having a diameter substantially equal to the first diameter at its outer end, and having a second diameter at its inner end which is sufficiently smaller than the first diameter to prevent the shear pin from exiting through the inner end.

8. The basket of claim 7 wherein the keeper means includes:

a. a single shear pin extending into both said first and second apertures; and b. a set screw threaded into the first aperture behind the shear pin.

9. Apparatus for retrieving an object at the bottom of a well comprising:

a. an outer tubular member adapted at its upper end to be attached to the lower end of a pipe string in the well;

b. a hollow cylindrical basket positioned in an upper portion of the inner wall of the outer tubular member;

c. an inner tubular member fitted within the outer tubular member in an axially slideable relation between an upper position in which the upper end of the inner tubular member extends above the lower end of the basket and the lower end of the inner tubular member extends beyond the lower end of the outer tubular member a first distance, and a lower position in which the lower end of the inner tubular member extends beyond the lower end of the outer tubular member a second distance;

d. a plurality of arcuately spaced fingers pivotably mounted in the wall of the basket, the fingers biased to normally assume a first extended position extending radially inwardly relative to the basket to define a basket bottom when the inner tubular member is in its said lower position; said fingers responsive to movement of said inner tubular member into its upper said position to assume a retracted position in the wall of the basket;

e. a spring interposed between the inner tubular member and the outer tubular member biased to urge the inner tubular member toward its said lower position; and f. a separate aperture in the wall of each said tubular member positioned to be in axial alignment when the inner tubular member is in its upper said position to receive a shear pin.

10. The apparatus of claim 9 further comprising a releasable interengaging member between the inner and outer tubular members capable when so interengaging of restraining relative axial movment between the two tubular members.

* * * * *